US008943854B2

(12) United States Patent
Persson

(10) Patent No.: US 8,943,854 B2
(45) Date of Patent: Feb. 3, 2015

(54) HEAT EXCHANGER AND AIR CONDITION SYSTEM

(75) Inventor: Lars Persson, Guizhou (CN)

(73) Assignee: Danfoss Qinbao (Hangzhou) Plate Heat Exchanger Company Limited, Hangzhou, Zhejiang (CN)

( * ) Notice: Subject to any disclaimer, the term of this patent is extended or adjusted under 35 U.S.C. 154(b) by 245 days.

(21) Appl. No.: 13/143,300

(22) PCT Filed: Jan. 6, 2009

(86) PCT No.: PCT/CN2009/070041

§ 371 (c)(1),
(2), (4) Date: Sep. 30, 2011

(87) PCT Pub. No.: WO2010/078722

PCT Pub. Date: Jul. 15, 2010

(65) Prior Publication Data

US 2012/0017624 A1 Jan. 26, 2012

(51) Int. Cl.
*F25B 39/02* (2006.01)
*F25B 1/06* (2006.01)

(Continued)

(52) U.S. Cl.
CPC ..... *F25B 39/022* (2013.01); *F28D 9/005* (2013.01); *F28D 9/0093* (2013.01); *F28F 9/028* (2013.01)
USPC ..... 62/525; 62/504; 62/515; 62/500; 62/116; 62/84; 62/468; 62/527; 62/528; 165/109.1; 165/140; 165/167; 165/174

(58) Field of Classification Search
CPC ..... F28F 9/02; F28F 3/00; F28D 7/00; F25B 30/00; F25B 39/02; F25B 39/022
USPC ..... 62/504, 515, 525, 500, 116, 84, 468, 62/527, 528; 165/109.1, 140, 167, 174
See application file for complete search history.

(56) References Cited

U.S. PATENT DOCUMENTS 2,159,251 A * 5/1939 Brizzolara ..... 62/117

(Continued)

FOREIGN PATENT DOCUMENTS

| | | | |
|---|---|---|---|
| CN | 1283777 | A | 2/2001 |
| EP | 0 895 051 | A1 | 2/1999 |
| WO | 02/073114 | A1 | 9/2002 |

OTHER PUBLICATIONS

International search report for PCT/CN2009/070041 dated Oct. 15, 2009.

*Primary Examiner* — Frantz Jules
*Assistant Examiner* — Erik Mendoza-Wilkenfe
(74) *Attorney, Agent, or Firm* — McCormick, Paulding & Huber LLP

(57) ABSTRACT

Disclosed is a heat exchanger of a plate type comprising an evaporator having at least one inlet and at least one outlet allowing a first medium to enter into and exit from the evaporator. The evaporator comprises a plurality of interconnected evaporation chambers disposed in parallel, having at least one common inlet and at least one common outlet allowing the first medium to enter into and exit from the evaporation chambers. An injector (495) is provided in at least one of the evaporation chambers, the injector comprises a channel, the channel is connected at one end with the common inlet of the evaporation chamber and is connected at the other end with an expanded outlet which opens to the evaporation chamber, the channel is much narrower than the common inlet so as to form a jet flow when the first medium flows through the channel, and a hole (180, 480) is formed at the intersecting point between the channel and the expanded outlet or formed on the channel near the intersecting point between the channel and the expanded outlet. With the technical solution of the invention, the efficiency of the evaporator and thus the heat exchanger can be improved, and the wear of a compressor connected to and co-operating with the evaporator can be reduced.

10 Claims, 3 Drawing Sheets

(51) Int. Cl.

| | |
|---|---|
| ***F25B 41/06*** | (2006.01) |
| ***F25B 43/02*** | (2006.01) |
| ***F25B 1/00*** | (2006.01) |
| ***F28F 13/12*** | (2006.01) |
| ***F28D 7/10*** | (2006.01) |
| ***F28F 3/08*** | (2006.01) |
| ***F28F 9/02*** | (2006.01) |
| ***F28D 9/00*** | (2006.01) |

(56) References Cited

U.S. PATENT DOCUMENTS

| | | | | |
|---|---|---|---|---|
| 2,519,845 | A * | 8/1950 | Mojonnier et al. | 62/306 |
| 2,724,246 | A * | 11/1955 | Lowe | 62/119 |
| 3,976,128 | A * | 8/1976 | Patel et al. | 165/153 |
| 4,370,868 | A * | 2/1983 | Kim et al. | 62/504 |
| 5,390,507 | A | 2/1995 | Shimoya et al. | |
| 5,448,899 | A | 9/1995 | Ohara et al. | |
| 6,367,265 | B1 * | 4/2002 | Yamamoto et al. | 62/50.2 |
| 7,490,661 | B2 * | 2/2009 | Nishino et al. | 165/174 |
| 2001/0017202 | A1 | 8/2001 | Mitsumoto et al. | |
| 2006/0179875 | A1 * | 8/2006 | Persson | 62/515 |
| 2010/0037652 | A1 * | 2/2010 | Gorbounov et al. | 62/527 |

* cited by examiner

HEAT EXCHANGER AND AIR CONDITION SYSTEM

CROSS REFERENCE TO RELATED APPLICATIONS

This application is entitled to the benefit of and incorporates by reference essential subject matter disclosed in International Patent Application No. PCT/CN2009/070041 filed on Jan. 6, 2009.

FIELD OF THE INVENTION

The present invention relates generally to an evaporator and more specifically to an evaporator equipped with injectors in each evaporation chamber for improving the stability and increase the efficiency and decreasing the wear of a cooperating compressor. The invention also relates a heat exchanger of the plate type equipped with such an evaporator.

BACKGROUND OF THE INVENTION

Evaporators and condensers are devices e.g. used for heat exchangers, such as slender tube heat exchangers, plate type heat exchangers, spiral heat exchangers and etc. In a heat exchanger according to the plate type, the media circulates inside alternating plates, typically made of metal and brazed together with sealed inlets and outlets forming closed duct systems within a package of interacting, interconnected, plates in which the media circulate under heat exchange. The published patent application WO003189 describes such a plate type heat exchanger in more detail.

FIG. 1 illustrates the working principle of a conventional heat exchanger with a compressor driven evaporation process. Such a heat exchanger includes an evaporation chamber 110', a compressor 120', a condenser chamber 130' and an expansion valve 140'.

As is well known in the art, the cooling medium in the evaporation chamber 110' absorbs heat $Q_{in}$, and thereafter evaporates whereupon it is directed to the compressor 120', and then further directed to the condenser chamber 130' where the medium emits heat $Q_{out}$ and condenses. The medium is then fed back to the evaporation chamber 110' through the expansion valve 140'.

During operation, the cooling medium coming from the expansion valve 140' enters the evaporation chamber 110' through the inlet of the evaporation chamber 110', and the cooling medium absorbs heat and evaporates, and then the evaporated medium enters the compressor.

A concern with the heat exchanger relates to the fact that since the cooling medium in the evaporator is distributed in several parallel evaporation chambers, the cooling medium is in two phases (liquid and gas) and the cooling capacity mainly depends on the cooling medium in liquid state, it's important that the velocity of the liquid medium is equal in each evaporation chamber. Furthermore the velocity of the cooling medium in gas state will create main part of the pressure drop. Normally in an evaporator such as that show in FIG. 1, the evaporation chambers are separated from each other and this makes it difficult to stabilize the liquid medium velocity in each evaporation chamber.

Furthermore lubricant oil will be accumulated in the lower part of the evaporation chamber and will stall around corner of the lower part of the evaporation chamber and does not fully mix with the cooling medium, so only a small part of the lubricant oil is entrapped in the evaporated medium and is brought into the compressor, and this will cause damage to the compressor, because most of the lubricant oil can not reach the compressor, and thus the compressor may be in a condition of lack of lubricant oil, resulting in the reduction of the use life of the compressor and some other problems.

SUMMARY OF THE INVENTION

The present invention is aimed to solve the problems associated with conventional heat exchanger.

One object of the present invention is to decrease the wear of a compressor connected to and co-operating with an evaporator.

Another object of the present invention is to provide a more efficient evaporator.

Still another object of the present invention is to improve the efficiency of heat exchangers in general and heat exchangers of the plate type in particular.

To achieve the object of the invention, according to first aspect of the invention these is provided a heat exchanger of a plate type comprising an evaporator having at least one inlet and at least one outlet allowing a first medium to enter into and exit from said evaporator, wherein said evaporator comprises a plurality of interconnected evaporation chambers disposed in parallel, having at least one common inlet and at least one common outlet allowing the first medium to enter into and exit from said evaporation chambers, wherein an injector being provided in at least one of the evaporation chambers, said injector comprising a channel, the channel being connected at one end with the common inlet of the evaporation chamber and being connected at the other end with an expanded outlet which opens to the evaporation chamber, the channel being much narrower than the common inlet so as to form a jet flow when the first medium flows through the channel, and a hole being formed at the intersecting point between the channel and the expanded outlet or formed on the channel near the intersecting point between the channel and the expanded outlet.

Preferably, the expanded outlet is a trumpet outlet. Preferably, the injector is provided in each of the evaporation chambers.

Preferably, an additional hole is provided through which the evaporation chambers communicate with each other.

Preferably, the heat exchanger is formed of interacting alternating plates having a groove pattern forming at least two separate duct loop systems allowing the first medium to circulate in the first of said duct loop systems under heat exchange with a second medium circulating in the second of said duct loop systems, wherein said first duct loop system comprises a part forming said plurality of interconnected evaporation channels.

Preferably, the interacting plates form a third duct loop system in which a third medium circulates under heat exchange with at least said first medium.

Preferably, the evaporation chambers have one delimited zone defined, and the outlet of said evaporation chambers is connected, via a compressor, to a part of said first duct loop system forming a condenser chamber having a substantially vertical channel piloting said first medium from said chamber's lower part up into another delimited defined zone, wherein said first medium can circulate in said two delimited zones under heat exchange with itself.

Preferably, the heat exchanger comprises:

a first duct chamber having an inlet and an outlet allowing a second medium to enter said first duct chamber through said inlet to be piloted through said first duct chamber under heat exchange with said first medium, and to leave said first duct chamber through said outlet, said plurality of interconnected evaporation chambers having one delimited zone, allowing said first medium to enter through said common inlet to be piloted through said evaporation chambers under heat exchange with said second medium and further through said zone under heat exchange with itself, and to leave said evaporation chambers through said common outlet, and, a compressor and a condenser chamber having an inlet and an outlet, said condenser chamber further having another delimited zone and a substantially vertical channel leading to said another delimited zone from said condenser chamber's lower part, and said compressor being connected to said common outlet and said inlet, allowing said first medium to be piloted from said common outlet into said condenser chamber through said inlet via said compressor and further piloted through said condenser chamber under heat exchange with third medium, and further piloted up through said channel into and through said other zone through which said first medium is allowed to be piloted under heat exchange with itself and thereafter to leave said condenser chamber through said outlet, and, an expansion valve connected to said outlet and said common inlet allowing said first medium to be piloted from said condenser chamber into said evaporation chambers through said common inlet via said expansion valve, and, a second duct chamber having an inlet and an outlet allowing said third medium to enter into said second duct chamber through said inlet and to be piloted through said duct chamber under heat exchange with said first medium and allowing said third medium to leave said duct chamber through said outlet.

According to a second aspect of the invention, there is provided a heat pump system, which comprises a heat exchanger according to the first aspect of the invention.

According to a second aspect of the invention, there is provided an air condition system which comprises a heat exchanger according to the first aspect of the invention.

With the technical solution of the invention, the efficiency of the evaporator and thus the heat exchanger can be improved, and the wear of a compressor connected to and co-operating with the evaporator can be reduced.

BRIEF DESCRIPTION OF THE DRAWINGS

The invention will be described in detail below, with reference to the accompanying drawings, in which.

DETAILED DESCRIPTION OF THE PREFERRED EMBODIMENTS

Figure 1:
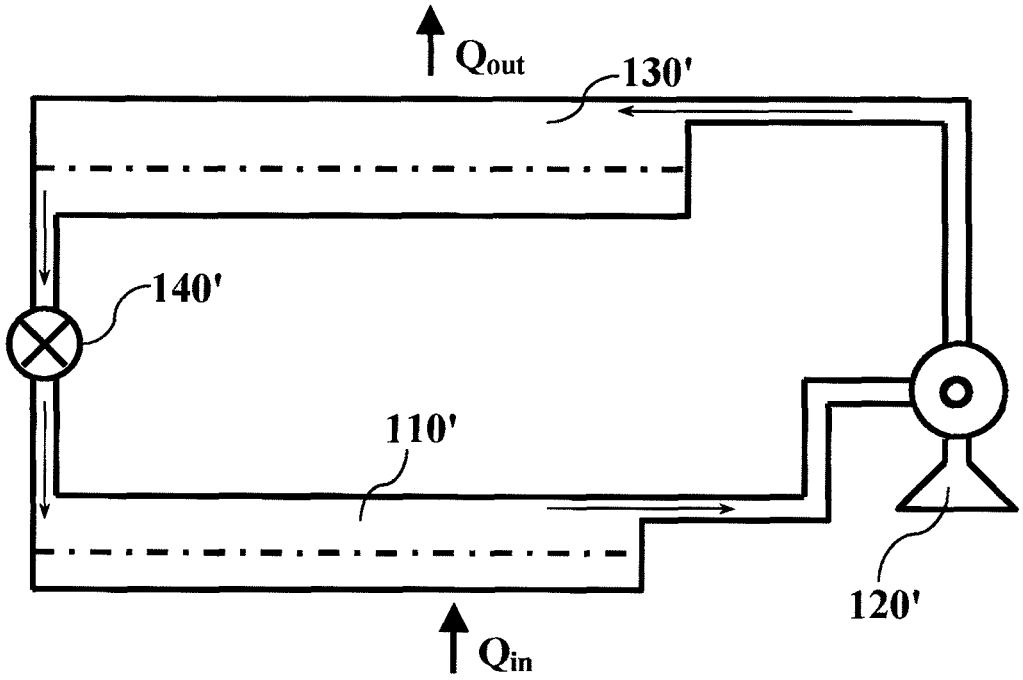
Fig. 1 Prior art
FIG. 1 illustrates the working principle of a conventional heat exchanger.
Figure 2:
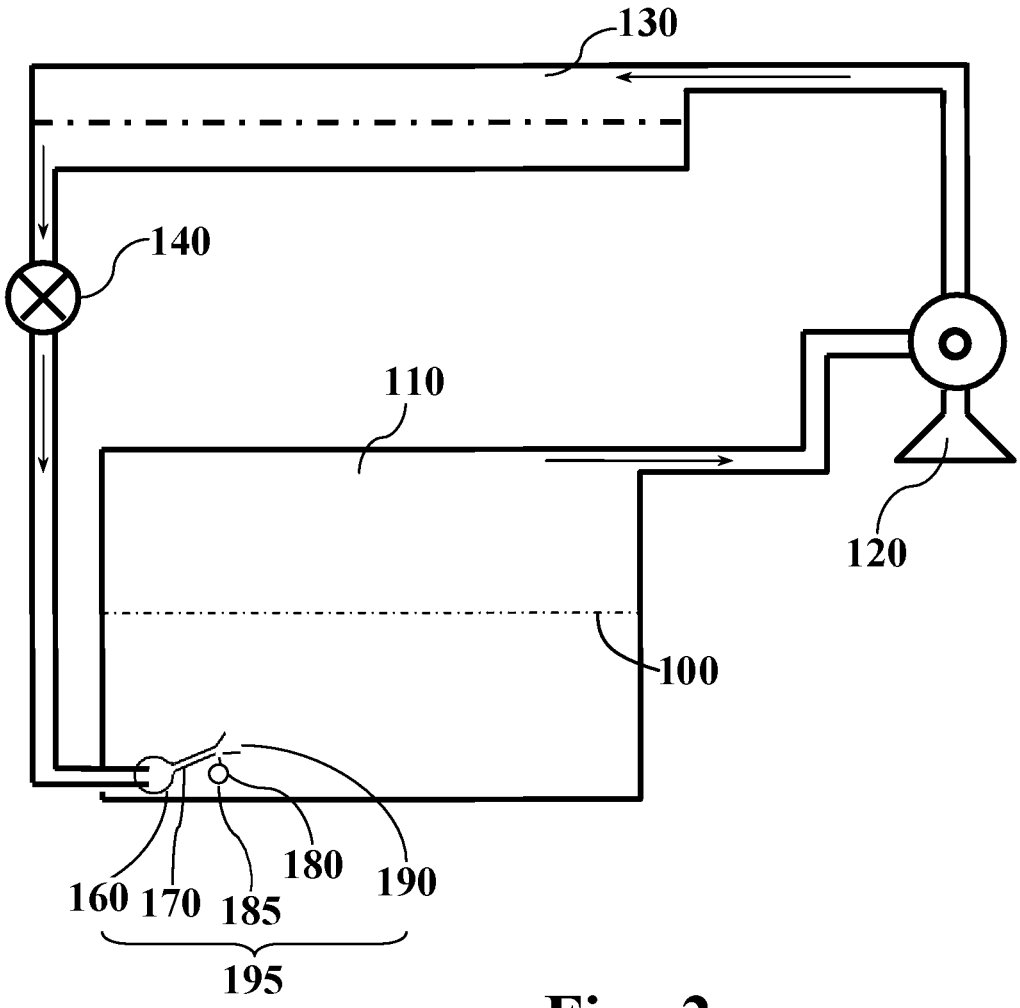
FIG. 2 illustrates an embodiment of an evaporator used in a heat exchanger according to the present invention.

Reference is now made to FIG. 2 which shows an embodiment of an evaporator used in a heat exchanger according to the present invention. As shown in FIG. 2, the heat exchanger comprises an evaporation chamber 110, a compressor 120, a condenser chamber 130 and an expansion means 140 such as an expansion valve, a capillary tube and etc.

The working principle of the heat exchanger is as follows. Medium, e.g. a coolant medium such as freon, circulates from the evaporation chamber 110 to the compressor 120 and further to the condenser 130 and finally back into the evaporation chamber 110 via the expansion valve 140, as shown in FIG. 2.

According to the invention, each evaporation chamber 110 is equipped with an injector 195 in its lower part. The injector 195, as shown in FIG. 2, comprises a narrow channel 170, a trumpet outlet 190 at the outlet end of the narrow channel 170, and a hole 180 as injection means. The hole 180 is preferably provided at the intersecting point between the narrow channel 170 and the trumpet outlet 190; alternatively, the hole 180 can also be provided on the narrow channel 170 near the intersecting point between the narrow channel 170 and the trumpet outlet 190. The narrow channel 170 is connected at its inlet end with the inlet 160 of the evaporation chamber 110. The dot-dash line 100 in FIG. 2 indicates the level of the liquid in the evaporation chamber 110.

Preferably, an additional hole 185 is provided between the adjacent evaporation chambers and connects the adjacent evaporation chambers, thus all the evaporation chambers communicate with each other through the holes 185. The holes 185 are located in the lower part of the evaporation chambers and below the level of the liquid, preferably the holes 185 are provided near the injector 195 at a lower left corner, as shown in FIG. 2.

The narrow channel 170 and the trumpet outlet 190 as well as the hole 180 can be formed in many ways which are obvious to one skilled in the art, e.g., they can be formed by a suitable interactive groove and/or recess pattern between the plates of the heat exchanger, and so is the hole 185. Thus, the invention is not limited to any particular manner of forming the narrow channel 170, the trumpet outlet 190 and the hole 180 as well as the hole 185.

Thus, during operation, the coolant medium, which comes from the expansion valve 140 and flows through the inlet 160 of the evaporation chamber 110, enters and flows through the narrow channel 170, and then enters the evaporation chamber 110 through the trumpet outlet 190.

So, on one hand, since the diameter of the narrow channel 170 is much smaller than that of the inlet 160, a jet flow is formed when the medium flows through the narrow channel 170, and this disturbs the flow in the evaporation chambers and causes the liquid to swirl in the evaporation chambers; and on the other hand, the hole 180 experiences a negative pressure producing an injector effect caused by the medium streaming through the narrow channel 170 from the inlet 160 to the trumpet outlet 190 at a relatively high velocity, this injector effect can be exploited to transport the liquid medium from the hole 180 to the trumpet outlet 190, and thus further disturbs the accumulated liquid in the evaporation chamber 110 and promotes the swirling of the liquid. Furthermore, the liquid coolant medium in the evaporation chambers communicate with each other through the holes 185, thus the liquid amount can be equalized with respect to each evaporation chamber and make the liquid velocity the same or substantially the same in all the evaporation chambers.

Accordingly, due to the swirling of the liquid caused by the injector 195, the liquid coolant medium and the lubricant oil are more fully mixed with each other on one hand, and on the other hand, the liquid coolant medium makes heat exchange with a medium to be cooled more efficiently, and thus increasing the efficiency of the evaporator. As a result, on one hand, with the improvement of the heat exchange, more liquid coolant medium evaporates; and on the other hand, since the lubricant oil and the liquid coolant medium are more fully mixed with each other, more lubricant oil is entrapped in the evaporated medium and reaches the compressor with the evaporated medium, so the compressor can be well lubricated and its wear can be reduced. Furthermore, since the liquid amount is equalized with respect to each evaporation chamber and the liquid velocity is made the same or substantially the same in all the evaporation chambers, the efficiency of the evaporator is further improved.

The heat exchanger with the evaporator according to the present invention will now be described in more detail for a specific case where the evaporator and condenser are realised in form of a heat exchanger of the plate type.

Plate type heat exchangers are generally known devices for heat exchange between different media and are used in a multitude of contexts, and the present invention is not limited to any special application. However, the invention is most easily applied to plate type heat exchangers of the wholly brazed type. This means that the heat exchanger consists of plates having a groove pattern and inlet and outlet connections for the media. The plates are placed in a package and are brazed together into a fixed unit. Separate ducts are thus formed for the media, typically circulating in opposite directions between alternate pairs of plates. The inlets and outlets extend through all plates and are thus common for the respective medium flowing in the ducts. This technique is commonly known and will not be described in detail here.

For illustrative purposes only, the invention will here be described for the particular case with a heat exchanger in which heat exchange takes place between three media, I, II and III, but the invention is applicable for heat exchange between an arbitrary numbers of media. The media used could for instance be: I=freon, II=brine and III=water, but other alternatives exist as known to a person skilled in the art.

Figure 3:
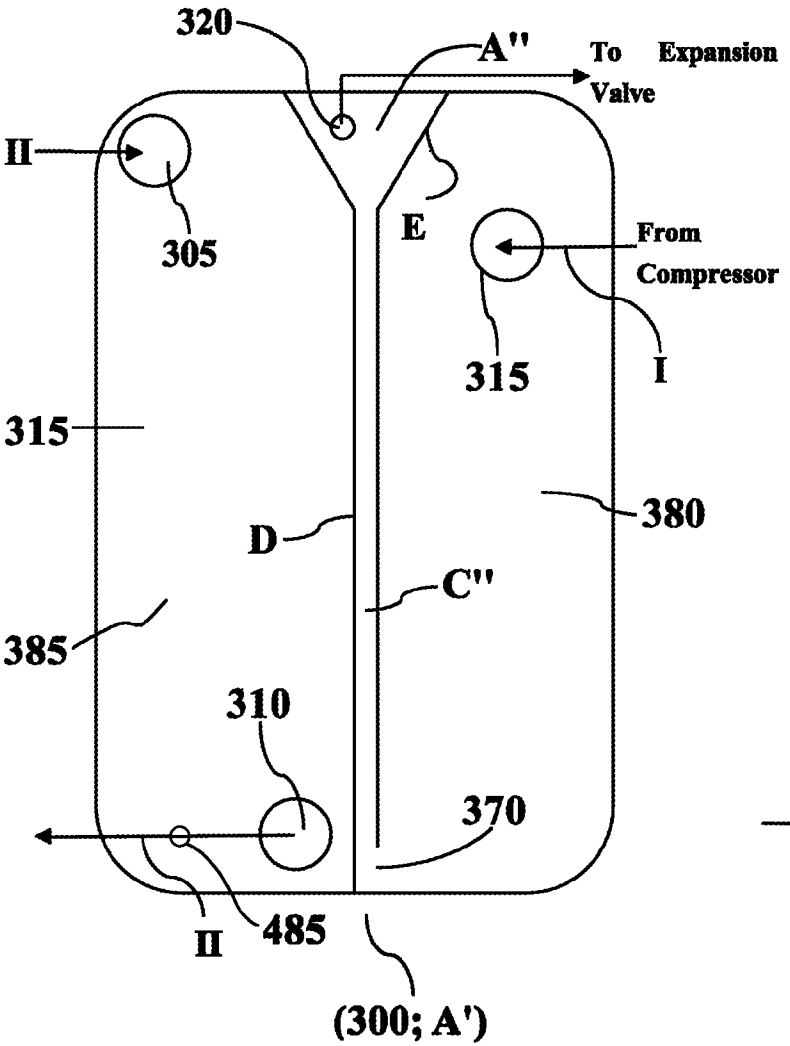
FIG. 3 illustrates an example of how a first plate side, i.e. an A' front side, of a plate type heat exchanger according to the present invention could be designed.

Referring now to FIG. 3, a front side A' of a plate 300 of a heat exchanger of the plate type according to the present invention is depicted. The plate in FIG. 3 is illustrated in its correct operational standing position, i.e. the force of gravity is working downwards in FIG. 3. The A' side is equipped with an inlet 305 and outlet 310 for medium II together with an inlet 315 and an outlet 320 for medium I. A barrier D separates the media from each other so that medium II will circulate to the left hand side of the barrier D and medium I to the right hand side of the barrier D in FIG. 3, i.e. in the condenser chamber 380. According to the invention, a further barrier E is provided which forms a delimited zone A" together with a channel C", between said zone A" and the condenser chamber 380 in which medium I circulates. The barriers are obtained by a suitable, interactive, groove and recess pattern between the plates as known, e.g. from the document WO003189 and will not be described in detail here.

Figure 4:
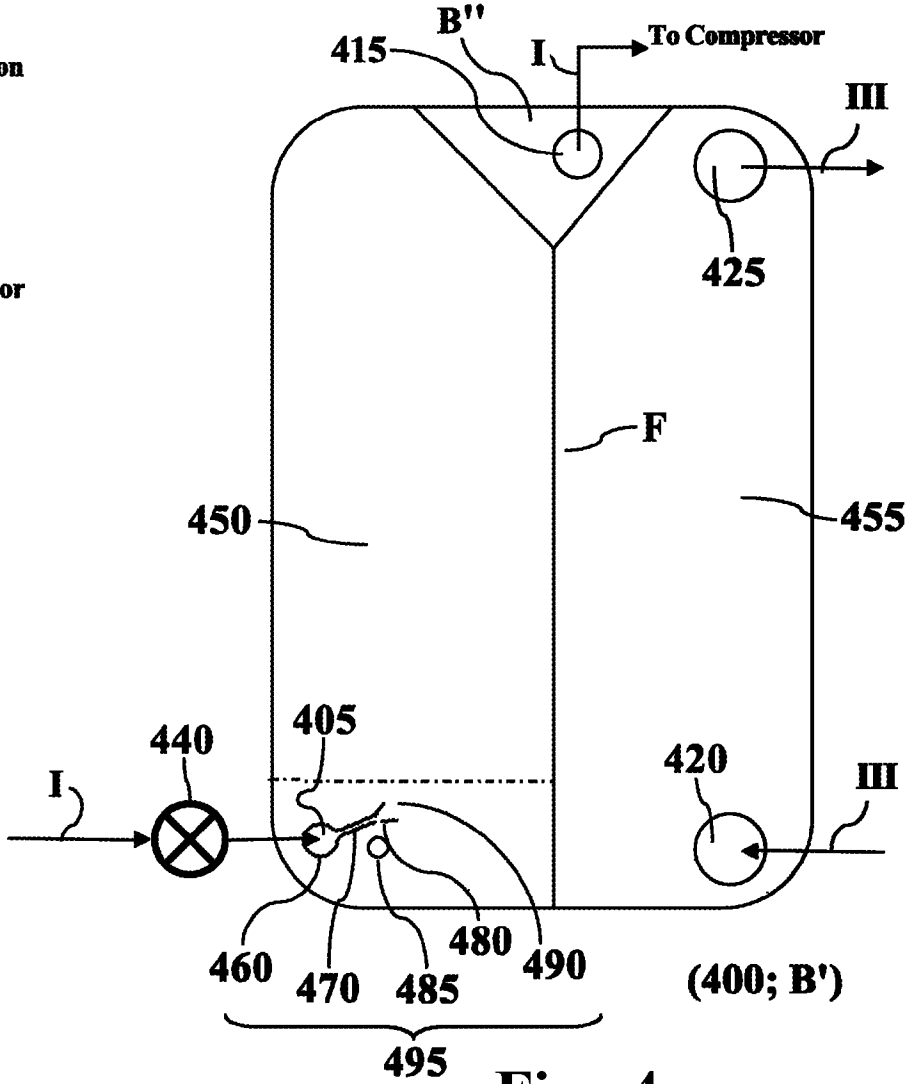
FIG. 4 illustrates an example of how a second plate side, i.e. a B' rear side, of a plate type heat exchanger according to the present invention could be designed.

Referring now to FIG. 4, the rear side B' of the plate 300 in FIG. 3 is illustrated in its correct operational standing position. The side B' has inlets 405 and 420 together with outlets 415 and 425, and a barrier F which separates the media from each other so that medium I will circulate to the left, in the evaporation chamber 450, and medium III to the right of the barrier F in FIG. 4. In addition, the invention provides an injector 495 along with an inlet 405 in the lower part of the evaporation chamber 450, according to the present invention.

The injector 495 has the identical function as the injector 195 described above with reference to FIG. 2, and can be realised in the same way. Thus, the injector 495 comprises a narrow channel 470, a trumpet outlet 490 at the outlet end of the narrow channel 470, and a hole 480 as injection means provided at the intersecting point between the narrow channel 470 and the trumpet outlet 490. The narrow channel 470 is connected at its inlet end with the inlet 405 of the evaporation chamber 450. The injector 495 can exploit the injector effect as explained above with reference to FIG. 2. The injector 495 according to the present invention thus automatically swirls or disturbs the media in the evaporation chamber 450. During operation, the jet flow is continuously generated by the narrow channel 470, and at the same time induces an internal circulation of the liquid through the hole 480 by the injector effect. At the time when the heat exchanger is turned off or stops for some reasons, the liquid will accumulate in the evaporation chamber 450 as a result. However, the injector 495 according to the present invention efficiently generates disturbance of the liquid in the evaporation chambers 450 and the liquid in the evaporation chambers are equalized through the holes 485 as soon as the heat exchanger is turned on. Thus, immediately after starting the heat exchanger, disturbance of the liquid will take place, and the liquid medium and the lubricant oil will be mixed effectively, and this increases the efficiency of the evaporator and the heat exchanger and decreases the wear of the compressor, as explained above.

Now, with reference to FIGS. 3 and 4, the working principle for the heat exchanger according to the present invention will be described. For purely illustrative purposes, a heat exchanger applied for a heat pump application will be described. Medium II, e.g. brine, enters at inlet 305 in FIG. 3 at a relatively higher temperature, e.g. corresponding to the ground temperature, e.g. at 12° C., and is piloted downwards in a duct chamber 385 under heat exchange with medium I, and thereafter leaves through the outlet 310 at a lower temperature, e.g. 7° C., to be piloted back to the ground in a closed loop.

The inlet 315 is fed with medium I, e.g. freon, by the compressor so that medium I enters the condenser chamber 380 through inlet 315 under high pressure and high temperature, e.g. 80° C. Medium I is piloted towards the inlet 370 of the channel C" under heat exchange with medium III and further up through the channel C" and piloted through the delimited zone A" under heat exchange with itself. Thus, the zone A" according to the present invention provides a double effect in that it works as a superheater during the evaporation stage of medium I and as a supercooler during the condensing stage of medium I. Thus, medium I is further condensed in the delimited zone A". This increases the efficiency of the heat exchanger, as a person skilled in the art will understand.

The medium I leaves the outlet 320 at a lower temperature, e.g. 32° C., and is thereafter fed to the expansion valve 440. After passing the expansion valve 440, medium I enters through inlet 405 at a considerable lower pressure and temperature, e.g. 2° C. The medium I starts to evaporate at a lower pressure and evaporates further when heated in evaporation chamber 450. Medium I is then piloted towards the delimited zone B" under heat exchange with medium II, to exit through outlet 415. When arriving at the delimited zone B", the temperature of medium I in this illustrative example will be around 7° C. Medium I has a heat exchange with itself in the delimited zone B", as described above, and is thus in this stage, i.e. the evaporation stage, subject for above described superheater function. The superheater ensures that all liquid evaporates before arriving to the compressor, which will further increase the efficiency of the heat exchanger and reduce the wear of the compressor, as a person skilled in the art realises.

Furthermore, accumulated medium I in form of liquid will be made to swirl by the injector 495 according to the present invention, as described above. Medium I will thereafter be directed from outlet 415, at a higher temperature, e.g. 10° C., to the compressor in a closed loop.

Thus, medium I circulates in a closed loop from evaporation chamber 450 to the compressor and further to the condenser chamber 380 and thereafter back to the evaporation chamber 450 through the expansion valve 440. Medium I can also swirl in the chamber 450 by the injector 495 according to the present invention, as described above.

Medium III, e.g. water, enters through the inlet 420 at a relatively lower temperature, e.g. 38° C., and leaves the outlet 425 at a relatively higher temperature, e.g. 44° C., since medium III has heat exchange with medium I in the heat exchanger. Medium III enters into a duct chamber 455 through an inlet 420 at a relatively low temperature, and is piloted through the duct chamber 455 under heat exchange with medium I. The medium III then leaves the duct chamber 455 through an outlet 425 at a relatively higher temperature. Thus, as a net effect, medium II has given a certain amount of heat to medium III.

In the embodiment described above, the outlet 490 at the outlet end of the narrow channel 470 is described as a trumpet outlet. However, the invention is not limited to this, and the outlet can be an expanded outlet of any form, so long as it can achieve the same function as a trumpet outlet which substantially decreases the flowing velocity of the media.

In the embodiment described above, an additional hole 185 is provided between the adjacent evaporation chambers to connect the adjacent evaporation chambers, so all the evaporation chambers communicate with each other through the holes 185. However, the hole 185 can be omitted.

Although the present invention has been described in the case for an evaporator and condenser in a heat exchanger of the plate type used for a heat pump application, it shall be understood that the invention is applicable in a wide variety of heating and/or cooling applications. For instance, a person skilled in the art realises that above described process can realise an air condition application, the heat exchanger need not be of a plate type etc. Furthermore, the evaporator according to the invention can be used not only in heat exchangers but is applicable in any evaporating process. FIGS. 3 and 4 are not to scale and illustrate merely the working principle of the invention by way of example. Therefore, a person skilled in the art can realise the invention in many different ways without departing from the scope of the present invention as defined by the following claims.

While the present invention has been illustrated and described with respect to a particular embodiment thereof, it should be appreciated by those of ordinary skill in the art that various modifications to this invention may be made without departing from the spirit and scope of the present.

What is claimed is:

1. A heat exchanger of a plate type comprising an evaporator having at least one inlet and at least one outlet allowing a first medium to enter into and exit from said evaporator, wherein said evaporator comprises a plurality of interconnected evaporation chambers disposed in parallel, having at least one common inlet and at least one common outlet allowing the first medium to enter into and exit from said evaporation chambers, wherein an injector is provided in at least one of the evaporation chambers, said injector comprising a channel, a first opening at one end of the channel being fluidly connected with the common inlet of the evaporation chamber and a second opening at the other end of the channel being fluidly connected with an expanded outlet which opens to the evaporation chamber, the channel being much narrower than the common inlet so as to form a jet flow when the first medium flows through the channel, and a hole being formed on a sidewall of the channel at the intersecting point between the channel and the expanded outlet or formed on the sidewall of the channel near the intersecting point between the channel and the expanded outlet, wherein the evaporator is formed by a plurality of interacting alternating plates that are stacked together to form the plurality of interconnected evaporation chambers between the plurality of interacting alternating plates, and wherein at least two adjacent interacting alternating plates each have formed thereon at least one of a mating groove or a recess pattern configured to form the injector in at least one of the evaporation chambers when the at least two adjacent interacting alternating plates are mated together.

2. The heat exchanger according to claim 1, wherein the expanded outlet is a trumpet outlet.

3. The heat exchanger according to claim 1, wherein the injector is provided in each of the evaporation chambers.

4. The heat exchanger according to claim 1, wherein an additional hole is provided through which the evaporation chambers communicate with each other.

5. The heat exchanger according to claim 1, wherein the heat exchanger is formed of interacting alternating plates having a groove pattern forming at least two separate duct loop systems allowing the first medium (I) to circulate in the first of said duct loop systems under heat exchange with a second medium (II) circulating in the second of said duct loop systems, wherein said first duct loop system comprises a part forming said plurality of interconnected evaporation chambers.

6. The heat exchanger according to claim 5, wherein said interacting plates form a third duct loop system in which a third medium (III) circulates under heat exchange with at least said first medium (I).

7. The heat exchanger according to claim 6, wherein said evaporation chambers have one delimited zone (B") defined, and the outlet of said evaporation chambers is connected, via a compressor, to a part of said first duct loop system forming a condenser chamber having a substantially vertical channel (C") piloting said first medium (I) from said chamber's lower part up into another delimited defined zone (A"), wherein said first medium (I) can circulate in said two delimited zones (A", B") under heat exchange with itself.

8. The heat exchanger according to claim 1, wherein the heat exchanger comprises:

a first duct chamber having an inlet and an outlet allowing a second medium (II) to enter said first duct chamber through said inlet to be piloted through said first duct chamber under heat exchange with said first medium (I), and to leave said first duct chamber through said outlet, said plurality of interconnected evaporation chambers having one delimited zone (B"), allowing said first medium (I) to enter through said common inlet to be piloted through said evaporation chambers under heat exchange with said second medium (II) and further through said delimited zone (B") under heat exchange with itself, and to leave said evaporation chambers through said common outlet, and, a compressor and a condenser chamber having an inlet and an outlet, said condenser chamber further having another delimited zone (A") and a substantially vertical channel (C") leading to said another delimited zone (A") from said condenser chamber's lower part, and said compressor being connected to said common outlet and said inlet, allowing said first medium (I) to be piloted from said common outlet into said condenser chamber through said inlet via said compressor and further piloted through said condenser chamber under heat exchange with a third medium (III), and further piloted up through said channel (C") into and through said other zone (A") through which said first medium (I) is allowed to be piloted under heat exchange with itself and thereafter to leave said condenser chamber through said outlet, and, an expansion valve connected to said outlet and said common inlet allowing said first medium (I) to be piloted from said condenser chamber into said evaporation chambers through said common inlet via said expansion valve, and, a second duct chamber having an inlet and an outlet allowing said third medium (III) to enter into said second duct chamber through said inlet and to be piloted through said second duct chamber under heat exchange with said first medium (I) and allowing said third medium (III) to leave said second duct chamber through said outlet.

9. A heat pump system, wherein the heat pump system comprises a heat exchanger according to claim 1.

10. An air condition system, wherein the air condition system comprises a heat exchanger according to claim 1.

* * * * *